US012644204B2

(12) United States Patent
Olah et al.

(10) Patent No.: US 12,644,204 B2
(45) Date of Patent: Jun. 2, 2026

(54) SPINNERET HOUSING FOR USE IN THE MANUFACTURE OF POLYMER FIBERS, AND METHOD OF USE THEREOF

(71) Applicant: Cytec Industries Inc., Princeton, NJ (US)

(72) Inventors: Janos Olah, Kelheim (DE); Varun Kumar, Greenville, SC (US); John Desmond Cook, Simpsonville, SC (US)

(73) Assignee: CYTEC INDUSTRIES INC., Lawrence, NJ (US)

( * ) Notice: Subject to any disclaimer, the term of this patent is extended or adjusted under 35 U.S.C. 154(b) by 9 days.

(21) Appl. No.: 18/696,809

(22) PCT Filed: Oct. 4, 2022

(86) PCT No.: PCT/EP2022/077493
§ 371 (c)(1),
(2) Date: Mar. 28, 2024

(87) PCT Pub. No.: WO2023/057403
PCT Pub. Date: Apr. 13, 2023

(65) Prior Publication Data

US 2024/0376640 A1 Nov. 14, 2024

Related U.S. Application Data

(60) Provisional application No. 63/252,673, filed on Oct. 6, 2021.

(51) Int. Cl.

| | |
|---|---|
| ***B29C 48/05*** | (2019.01) |
| ***D01D 4/02*** | (2006.01) |
| ***D01D 5/06*** | (2006.01) |

(52) U.S. Cl.
CPC ..... *D01D 4/02* (2013.01); *D01D 5/06* (2013.01); *D10B 2321/10* (2013.01)

(58) Field of Classification Search
CPC ..... B29C 48/05; D01D 4/02; D01D 5/06
USPC ..... 264/178 R, 182, 183, 184, 178 F; 425/67, 382.2, 461, 462, 463, 464
See application file for complete search history.

(56) References Cited

U.S. PATENT DOCUMENTS 2,416,291 A * 2/1947 Detwiler ..... D01D 5/06 264/188
2021/0332499 A1* 10/2021 Guo ..... B29C 48/05

FOREIGN PATENT DOCUMENTS

| | | | | |
|---|---|---|---|---|
| GB | 973085 | A * | 10/1964 | ..... B29C 48/05 |
| JP | 2008202189 | A | 9/2008 | |
| JP | 2017172081 | A | 9/2017 | |
| KR | 102266183 | B1 | 6/2021 | |
| WO | 2007013858 | A1 | 2/2007 | |
| WO | 2013141916 | A2 | 9/2013 | |

(Continued)

*Primary Examiner* — Leo B Tentoni
(74) *Attorney, Agent, or Firm* — Thi Dang

(57) ABSTRACT

The present disclosure relates to a spinneret housing for use in the production of polymer fibers, such as large tow polymer fibers, typically used in the manufacture of carbon fiber. The present disclosure also relates to a system comprising the spinneret housing and a process for producing polymer fibers using such a system. The polymer fibers produced are useful for the manufacture of carbon fiber, which finds application as structural components in composite materials relevant to many areas, such as the aerospace, marine, and automotive industries, among others.

11 Claims, 5 Drawing Sheets

(56) References Cited

FOREIGN PATENT DOCUMENTS

| | | | |
|---|---|---|---|
| WO | 2015130368 | A2 | 9/2015 |
| WO | 2016048885 | A1 | 3/2016 |

* cited by examiner

SPINNERET HOUSING FOR USE IN THE MANUFACTURE OF POLYMER FIBERS, AND METHOD OF USE THEREOF

CROSS REFERENCE TO RELATED APPLICATIONS

The instant application is a U.S. national phase entry under 35 U.S.C. § 371 of International Application No. PCT/EP2022/077493 filed on Oct. 4, 2022, which claims the benefit of prior U.S. provisional patent application No. 63/252,673, filed Oct. 6, 2021, the content of each of these prior filed application is incorporated herein by reference.

FIELD OF THE DISCLOSURE

The present disclosure relates to a spinneret housing for use in the production of polymer fibers, such as large tow polymer fibers, typically used in the manufacture of carbon fiber. The present disclosure also relates to a system comprising the spinneret housing and a process for producing polymer fibers using such a system.

The polymer fibers produced are useful for the manufacture of carbon fiber, which finds application as structural components in composite materials relevant to many areas, such as the aerospace, marine, and automotive industries, among others.

BACKGROUND OF THE DISCLOSURE

Carbon fibers have been used in a wide variety of applications because of their desirable properties, such as high strength and stiffness, high chemical resistance and low thermal expansion. For example, carbon fibers can be formed into a structural part that combines high strength and high stiffness, while having a weight that is significantly lighter than a metal component of equivalent properties.

Increasingly, carbon fibers are being used as structural components in composite materials for aerospace, marine, and automotive applications, among others. In particular, composite materials have been developed wherein carbon fibers serve as a reinforcing material in a resin or ceramic matrix.

Carbon fiber from acrylonitrile is generally produced by a series of manufacturing steps or stages, including polymerization, spinning, drawing and/or washing, oxidation, and carbonization. Polyacrylonitrile (PAN) polymer is currently the most widely used precursor for carbon fibers. During the polymerization stage, acrylonitrile (AN), optionally with one or more comonomers, is converted into PAN polymer. The PAN polymer is then subjected to spinning, drawing and/or washing, oxidation, and carbonization to produce carbon fiber.

With over 90% of carbon fiber being derived from PAN polymer, it is important to identify controllable parameters in the polymer properties that impact downstream processes with an aim towards faster production, lower cost, and/or easier manufacture of carbon fiber, especially large-tow carbon fiber.

During the spinning and coagulation step, polymer dope is extruded through a spinneret into a coagulation bath, where the polymer coagulates, forming a fiber tow or bundle. The volume of the fiber bundle continuously decreases along the coagulation bath and the used coagulant is squeezed out of it. This liquid enriched in solvent has a tendency to recirculate to the fiber coagulant zone, which is essentially the first few inches from the spinneret face. Since the laminar coagulant flow around the spinneret is not uniform due to the geometry of the coagulation bath and the immersed spinneret pack, the backflow rate of used coagulant will also vary causing non-uniform solvent concentration around the spinneret. Such a concentration gradient around the coagulation zone causes variability in filament formation.

Thus, there is an ongoing need for apparatuses and processes for producing polymer fibers that can reduce or eliminate the concentration gradients that appear around the coagulation zones during the coagulation step, thereby reducing or eliminating variability in filament formation, particularly of large-tow fibers.

SUMMARY OF THE DISCLOSURE

This objective, and others which will become apparent from the following detailed description, are met, in whole or in part, by the apparatuses, methods and/or processes of the present disclosure.

In a first aspect, the present disclosure relates to a spinneret housing having a body adapted to secure, typically removably, a spinneret or spinneret assembly, the body comprising:

- a flanged cylindrical wall extending from the body, wherein the flange is projected radially inward at the distal portion of the said wall,
- a cylindrical tube surrounding the body, wherein the said tube is coaxial to the flanged cylindrical wall and has a diameter larger than the flanged cylindrical wall, and a cowl extending from the cylindrical tube surrounding the body, wherein the
- cowl extends past the distal end of the flanged cylindrical wall.

In a second aspect, the present disclosure relates to a system for producing polymer fibers, the system comprising:

a) the spinneret housing described herein,
b) a polymer dope supply line,
c) a spinneret or spinneret assembly, typically for large tow, and
d) a coagulation bath comprising coagulation liquid.

In a third aspect, the present disclosure relates to a process for the production of polymer fibers, the process comprising:

a') providing the system described herein, and
b') spinning a polymer dope, which is supplied through the polymer dope supply line to the spinneret or spinneret assembly, into the coagulation bath.

In a fourth aspect, the present disclosure relates to one or more polymer fibers produced as described herein.

In a fifth aspect, the present disclosure relates to a process for producing carbon fiber, the process comprising:

(i) providing a polymer fiber described herein or producing a polymer fiber according to the process described herein;
(ii) oxidizing the polymer fiber produced in step (i) to form stabilized carbon fiber precursor fibers and then carbonizing the stabilized carbon fiber precursor fiber, thereby producing the carbon fiber.

In a sixth aspect, the present disclosure relates to a composite material comprising the carbon fiber produced according to the process described herein and a matrix resin.

DETAILED DESCRIPTION

Figure 1:
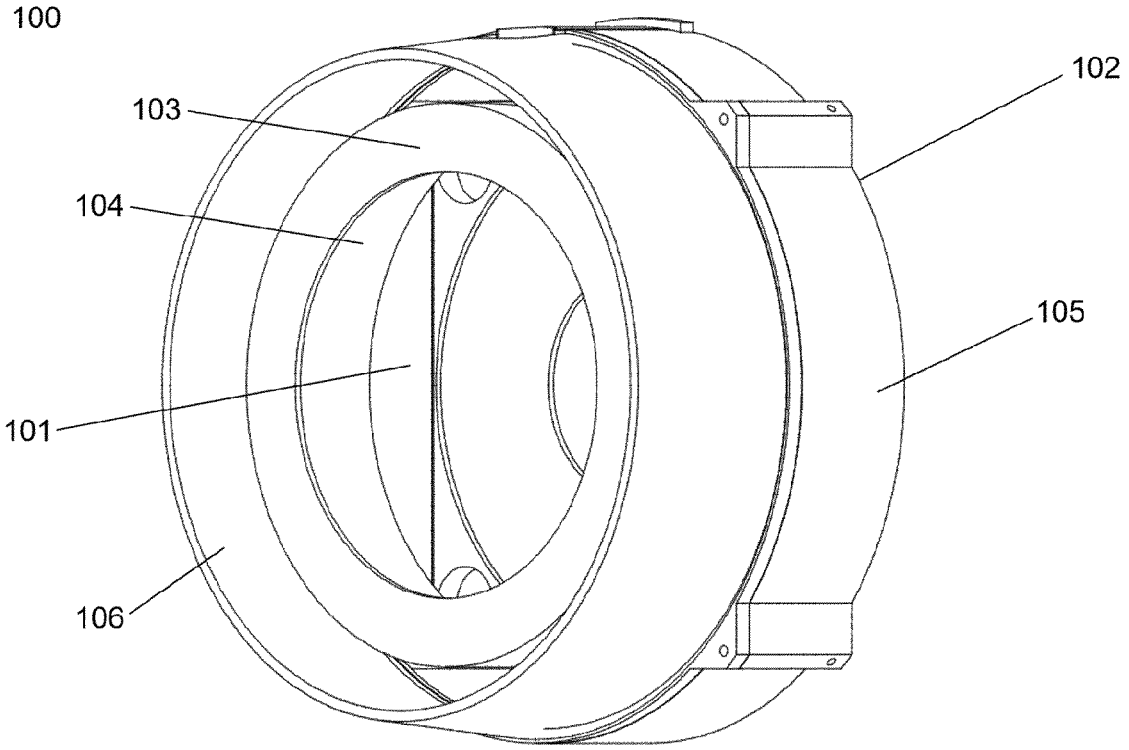
FIG. 1 shows a front perspective view of an embodiment of the spinneret housing described herein.

As used herein, the terms "a", "an", or "the" means "one or more" or "at least one" and may be used interchangeably, unless otherwise stated.

As used herein, the term "and/or" used in a phrase in the form of "A and/or B" means A alone, B alone, or A and B together.

As used herein, the term "comprises" includes "consists essentially of" and "consists of." The term "comprising" includes "consisting essentially of" and "consisting of." "Comprising", which is synonymous with "including," "containing," or "characterized by," is intended to be inclusive or open-ended and does not exclude additional, unrecited elements or steps. The transitional phrase "consisting essentially of" is inclusive of the specified materials or steps and those that do not materially affect the basic characteristic or function of the composition, process, method, or article of manufacture described. The transitional phrase "consisting of" excludes any element, step, or component not specified.

Unless defined otherwise, all technical and scientific terms used herein have the same meaning as is commonly understood by one of skill in the art to which this specification pertains.

As used herein, and unless otherwise indicated, the term "about" or "approximately" means an acceptable error for a particular value as determined by one of ordinary skill in the art, which depends in part on how the value is measured or determined.

In certain embodiments, the term "about" or "approximately" means within 1, 2, 3, or 4 standard deviations. In certain embodiments, the term "about" or "approximately" means within 50%, 20%, 15%, 10%, 9%, 8%, 7%, 6%, 5%, 4%, 3%, 2%, 1%, 0.5%, or 0.05% of a given value or range.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

The term and phrases "invention," "present invention," "instant invention," and similar terms and phrases as used herein are non-limiting and are not intended to limit the present subject matter to any single embodiment, but rather encompasses all possible embodiments as described.

In the first aspect, the present disclosure relates to a spinneret housing having a body adapted to secure, typically removably, a spinneret or spinneret assembly, the body comprising:

a flanged cylindrical wall extending from the body, wherein the flange is projected radially inward at the distal portion of the said wall, a cylindrical tube surrounding the body, wherein the said tube is coaxial to the flanged cylindrical wall and has a diameter larger than the flanged cylindrical wall, and a cowl extending from the cylindrical tube surrounding the body, wherein the cowl extends past the distal end of the flanged cylindrical wall.

Figure 2:
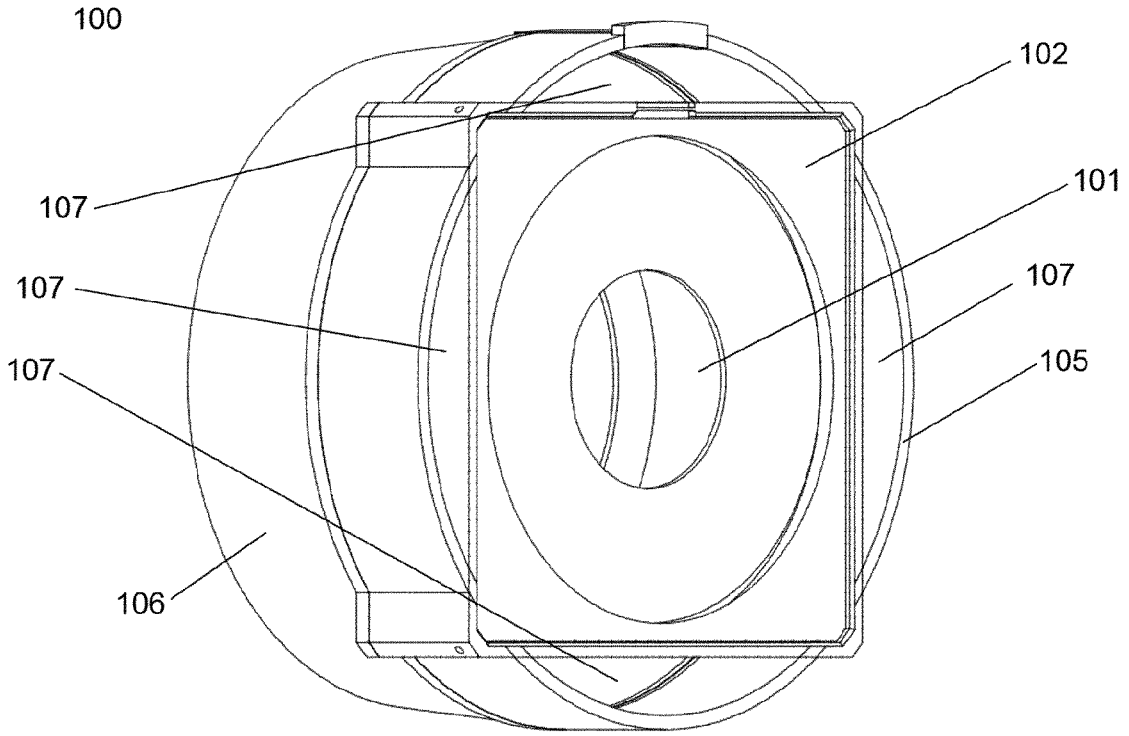
FIG. 2 shows a rear perspective view an embodiment of the spinneret housing described herein.

An exemplary embodiment of the spinneret housing is illustrated in FIG. 1 and FIG. 2 as spinneret housing 100. The spinneret housing 100 includes a body 101, which comprises a hollow interior shaped to accommodate and/or to secure a spinneret or spinneret assembly and a back cover 102. A spinneret or spinneret assembly may be securely permanently or removably, typically removably, in the spinneret housing.

The body 101 also includes a flanged cylindrical wall 104 extending from the body, wherein a flange 103 projects radially inward at the distal portion of the said wall. A cylindrical tube 105 surrounds the body. A cowl 106 extends from the cylindrical tube surrounding the body, which extends past the distal end of the flanged cylindrical wall.

As shown in FIG. 2, the cylindrical tube 105 is coaxial to the flanged cylindrical wall and has a diameter larger than the flanged cylindrical wall. The cylindrical tube 105 and the body 101 are such that there are one or more openings 107 that allow coagulation liquid to flow through and around the spinneret or spinneret assembly.

During spinning and coagulation, the volume of the fiber bundle extruded through the spinneret continuously decreases along the coagulation bath and the used coagulant is squeezed out of it. This liquid enriched in solvent has a tendency to recirculate to the fiber coagulant zone, which is essentially the first few inches from the spinneret face. Since the laminar coagulant flow around the spinneret is not uniform due to the geometry of the coagulation bath and the immersed spinneret pack, the backflow rate of used coagulant will also vary causing non-uniform solvent concentration around the spinneret. Such a concentration gradient around the coagulation zone causes variability in filament formation. The presence of the cowl 106 acts to eliminate the formation of concentration gradients around the coagulation zone, thus reducing or eliminating variability in filament formation. In case of different dope and coagulation bath temperatures, the cowl of the spinneret housing also reduces the temperature non-uniformity in the coagulation bath around the spinneret due to the insulation effect.

The shape of the cowl is not particularly limited as long as it extends past the distal end of the flanged cylindrical wall, which typically is the approximate position of the spinneret face. In an embodiment, the cowl has a cylindrical shape, a frustoconical shape, or a combination thereof. In one embodiment, the cowl has a frustoconical shape.

As would be understood by those of ordinary skill in the art, "frustoconical" refers to a truncated cone shape. In other words, "frustoconical" refers to a shape derived from the portion of a cone that lies between one or two planes, typically parallel planes, cutting it. The frustoconical shape may be symmetrical or asymmetrical. When the frustoconical shape is symmetrical, the cone from which the shape is derived is a right cone, i.e., has its apex on the axis that runs perpendicular through the center of the base of the cone, which is generally circular. In this case, the angle that the sides of the frustoconical shape make with the base is the same all around the shape. When the frustoconical shape is asymmetrical, the cone from which the shape is derived is an oblique cone, i.e., has an apex that is not on the axis that runs perpendicular through the center of the base of the cone. In this case, the angle that the sides of the frustoconical shape make with the base is not the same all around the shape.

The cowl may be a combination of a cylindrical shape and a frustoconical shape. In such a configuration, for example, the cowl may extend from the body first as a cylindrical shape and then change to a frustoconical shape.

The dimensions of the cowl are not particularly limited. However, in some embodiments, the length of the cowl, measured from the face of the flanged cylindrical wall to the distal opening is 10 to 100 mm, typically 15 to 40 mm. In some embodiments, the diameter of the distal opening of the cowl is 100 to 200, typically 150 to 190, more typically 160 to 190 mm.

Figure 3:
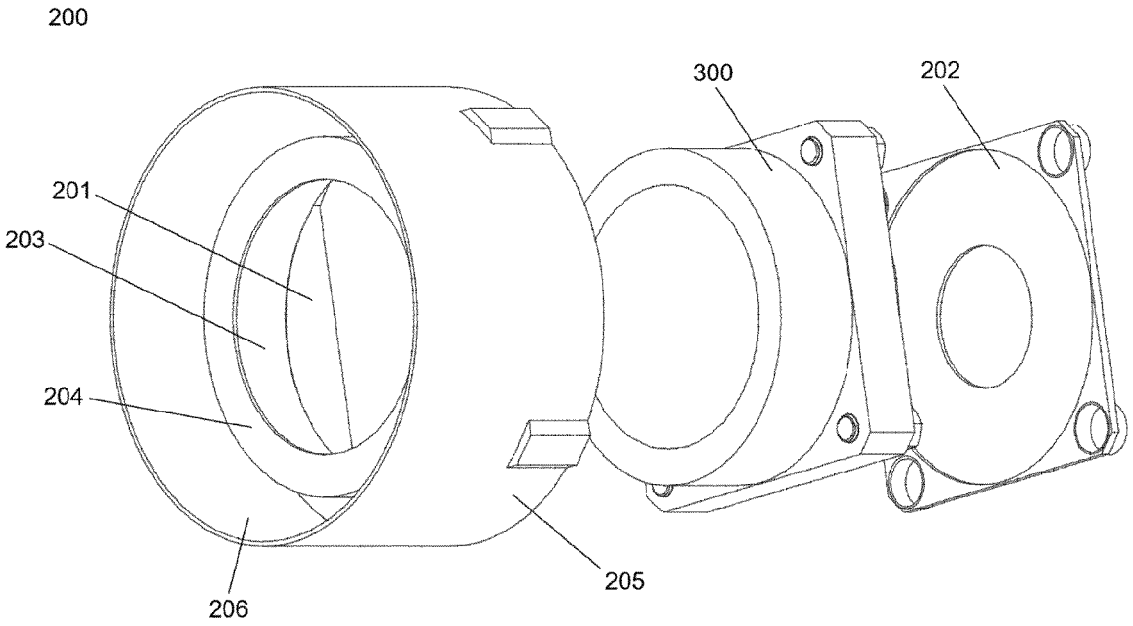
FIG. 3 shows an exploded view of an embodiment of the spinneret housing described herein.

The spinneret housing may be a combination of two or more parts secured together. The combination of two or more parts may be secured together in a permanent manner. However, it is advantageous for the combination of two or more parts to be secured together such that the parts can be separated when desired, for example, for maintenance, repair, replacement of one or more parts, or for removal or change of the spinneret. As illustrated in FIG. 3, an exemplary spinneret housing 200 may be a combination of a body 201, which comprises a hollow interior shaped to accommodate and/or to secure a spinneret or spinneret assembly 300 and a back cover 202. The body 201 also includes a flanged cylindrical wall 203 extending from the body, wherein a flange 204 projects radially inward at the distal portion of the said wall. A cylindrical tube 205 surrounds the body. A cowl 206 extends from the cylindrical tube surrounding the body, which extends past the distal end of the flanged cylindrical wall.

The cowl may be a permanent extension of the cylindrical tube, as shown in FIG. 3, or may be detachable, as shown in FIG. 2. In an embodiment, the cowl is detachable. Any means known to those of ordinary skill in the art may be used to attach, in a removable fashion, the cowl to the cylindrical tube, such as, for example, screws, clips, magnets, and the like.

The spinneret housing may be manufactured from materials known to those of ordinary skill in the art. Exemplary materials include, but are not limited to, metals, such as iron, cast iron, copper, brass, aluminum, titanium, carbon steel, stainless steel, and alloys thereof, and polymers, such as thermoset and thermoplastic resins. Exemplary thermoset resins include, but are not limited to, epoxy resins, oxetanes, vinyl ester resins, cyanate ester resins, isocyanate-modified epoxy resins, phenolic resins, furanic resins, benzoxazines, formaldehyde condensate resins (such as with urea, melamine or phenol), polyesters, acrylics, hybrids, blends and combinations thereof. Exemplary thermoplastic polymers include, but are not limited to, acrylonitrile butadiene styrene (ABS), polypropylene, polystyrene, polyvinyl chloride, polylactic acid, polyamides (PA), such as aliphatic polyamides and semi-aromatic polyamides; polyimides (PI), polyarylether ketones (PAEK), polyamide-imides (PAI), polyarylene sulfides (PAS), such as polyphenylene sulfides (PPS); polyarylether sulfones (PAES), polyether ether ketone (PEEK), fluoropolymers (FP), such as polyvinylidene fluoride; polycarbonate, and combinations thereof.

In the second aspect, the present disclosure relates to a system for producing polymer fibers, the system comprising:

a) the spinneret housing described herein, b) a polymer dope supply line, c) a spinneret or spinneret assembly, typically for large tow, and d) a coagulation bath comprising coagulation liquid.

The system described herein is used for producing polymer fibers, typically for the spinning of a polymer dope, or "spin dope", into a coagulation bath. The spinneret or spinneret assembly is connected to the polymer dope supply line, which acts to convey the polymer dope from a polymer dope source, such as a holding tank having the polymer dope, to the spinneret through the action of one or pumps. The polymer fibers coagulate in the coagulation bath containing the coagulation liquid.

In an embodiment, the spinneret or spinneret assembly is secured, typically removably, in the spinneret housing.

In an embodiment, the polymer dope supply line is connected to the inlet of the spinneret.

In the third aspect, the present disclosure relates to a process for the production of polymer fibers, the process comprising:

a') providing the system described herein, and b') spinning a polymer dope, which is supplied through the polymer dope supply line to the spinneret or spinneret assembly, into the coagulation bath.

During the manufacture of polymer fibers, such as those suitable for making carbon fiber in downstream processes, a polymer solution (i.e., spin "dope") is typically spun into a coagulation bath. The spin dope can have a polymer concentration of at least 10 wt %, typically from about 16 wt % to about 28 wt % by weight, more typically from about 19 wt % to about 24 wt %, based on total weight of the solution. The dope is filtered and extruded through holes of the spinneret (typically made of metal) into a liquid coagulation bath for the polymer to form filaments. The spinneret holes determine the desired filament count of the fiber (e.g., 3,000 holes for 3K carbon fiber). In an embodiment, the spinneret is for large tow fiber, typically 24K to 50K fiber.

The coagulation liquid used in the process is a mixture of solvent and non-solvent.

Water or alcohol is typically used as the non-solvent. Suitable solvents include the solvents described herein. In an embodiment, dimethyl sulfoxide, dimethyl formamide, dimethyl acetamide, or mixtures thereof, is used as solvent. In another embodiment, dimethyl sulfoxide is used as solvent. The ratio of solvent and non-solvent, and bath temperature are not particularly limited and may be adjusted according to known methods to achieve the desired solidification rate of the extruded nascent filaments in coagulation. However, the coagulation bath typically comprises 40 wt % to 85 wt % of one or more solvents, the balance being non-solvent, such as water or alcohol. In an embodiment, the coagulation bath comprises 40 wt % to 70 wt % of one or more solvents, the balance being non-solvent. In another embodiment, the coagulation bath comprises 50 wt % to 85 wt % of one or more solvents, the balance being non-solvent.

Typically, the temperature of the coagulation bath is from 0° C. to 80° C. In an embodiment, the temperature of the coagulation bath is from 30° C. to 80° C. In another embodiment, the temperature of the coagulation bath is from 0° C. to 20° C.

To examine the fiber tows, cross sectional images of the tows are taken using a digital microscope and then image analysis software is used to determine the filament diameter and corresponding distributions. The distribution data is then analyzed using statistical analysis software, such as JMP, to determine the filament variability. The filament circularity is determined using image analysis software to analyze the cross-sectional shape of the filaments. Filament circularity is typically normalized so that the value ranges from zero to one. Filament circularity equal to one is considered an ideal case of a circle.

In an embodiment, the variability in filament diameter and/or circularity is reduced by 5 to 50%, typically 10 to 40%, more typically 20 to 25%, compared to the variability in filament diameter and/or circularity obtained in a process in which the spinneret housing is absent.

In the fourth aspect, the present disclosure relates to one or more polymer fibers produced as described herein.

In an embodiment, the filament diameter is 1 to 50 μm, typically 7 to 25 μm, more typically 9 to 20 μm, still more typically 10 to 16 μm.

In an embodiment, the variability in the filament diameter is less than 2.1, typically less than 2.

In an embodiment, the filament circularity is 0.75 to 1, typically 0.75 to 0.85.

In an embodiment, the variability in the filament circularity is less than 0.07.

In the fifth aspect, the present disclosure relates to a process for producing carbon fiber, the process comprising:

(i) providing a polymer fiber described herein or producing a polymer fiber according to the process described herein, (ii) oxidizing the polymer fiber produced in step (i) to form stabilized carbon fiber precursor fibers and then carbonizing the stabilized carbon fiber precursor fiber, thereby producing the carbon fiber.

The polymer fiber described herein or produced according to the process described herein may be oxidized to form stabilized carbon fiber precursor fibers and, subsequently, the stabilized carbon fiber precursor fiber are carbonized to produce carbon fibers.

During the oxidation stage, the polymer fiber are fed under tension through one or more specialized ovens, each having a temperature from 150 to 300° C., typically from 200 to 280° C., more typically from 220 to 270° C. Heated air is fed into each of the ovens. The polymer fibers are conveyed through the one or more ovens at a speed of from 4 to 100 fpm, typically from 30 to 75 fpm, more typically from 50 to 70 fpm.

The oxidation process combines oxygen molecules from the air with the fiber and causes the polymer chains to start crosslinking, thereby increasing the fiber density to 1.3 $g/cm^3$ to 1.4 $g/cm^3$. In the oxidization process, the tension applied to fiber is generally to control the fiber drawn or shrunk at a stretch ratio of 0.8 to 1.35, typically 1.0 to 1.2. When the stretch ratio is 1, there is no stretch. And when the stretch ratio is greater than 1, the applied tension causes the fiber to be stretched. Such oxidized fiber, typically PAN fiber, has an infusible ladder aromatic molecular structure and it is ready for carbonization treatment.

Carbonization results in the crystallization of carbon molecules and consequently produces a finished carbon fiber that has more than 90 percent carbon content.

Carbonization of the oxidized, or stabilized, carbon fiber precursor fibers occurs in an inert (oxygen-free) atmosphere, typically nitrogen atmosphere, inside one or more specially designed furnaces. The oxidized carbon fiber precursor fibers are passed through one or more ovens each heated to a temperature of from 300° C. to 1650° C., typically from 1100° C. to 1450° C.

Adhesion between the matrix resin and carbon fiber is an important criterion in a carbon fiber-reinforced polymer composite. As such, during the manufacture of carbon fiber, surface treatment may be performed after oxidation and carbonization to enhance this adhesion.

Surface treatment may include pulling the carbonized fiber through an electrolytic bath containing an electrolyte, such as ammonium bicarbonate or sodium hypochlorite. The chemicals of the electrolytic bath etch or roughen the surface of the fiber, thereby increasing the surface area available for interfacial fiber/matrix bonding and adding reactive chemical groups.

Next, the carbon fiber may be subjected to sizing, where a size coating, e.g. epoxy-based coating, is applied onto the fiber. Sizing may be carried out by passing the fiber through a size bath containing a liquid coating material. Sizing protects the carbon fiber during handling and processing into intermediate forms, such as dry fabric and prepreg. Sizing also holds filaments together in individual tows to reduce fuzz, improve processability and increase interfacial shear strength between the fiber and the matrix resin.

Following sizing, the coated carbon fiber is dried and then wound onto a bobbin.

A person of ordinary skill in the art would understand that the processing conditions (including composition of the spin solution and coagulation bath, the amount of total baths, stretches, temperatures, and filament speeds) may be altered to provide filaments of a desired structure and denier without departing from the spirit of the present disclosure.

In a sixth aspect, the present disclosure relates to a composite material comprising the carbon fiber produced according to the process described herein and a matrix resin.

Composite materials may be made by molding a preform comprising the carbon fiber produced according to the process described herein and infusing the preform with a thermosetting resin in a number of liquid-molding processes. Liquid-molding processes that may be used include, without limitation, vacuum-assisted resin transfer molding (VARTM), in which resin is infused into the preform using a vacuum-generated pressure differential. Another method is resin transfer molding (RTM), wherein resin is infused under pressure into the preform in a closed mold. A third method is resin film infusion (RFI), wherein a semi-solid resin is placed underneath or on top of the preform, appropriate tooling is located on the part, the part is bagged and then placed in an autoclave to melt and infuse the resin into the preform.

The matrix resin for impregnating or infusing the preforms described herein is a curable resin. "Curing" or "cure" in the present disclosure refers to the hardening of a polymeric material by the chemical cross-linking of the polymer chains. The term "curable" in reference to a composition means that the composition is capable of being subjected to conditions which will render the composition to a hardened or thermoset state. The matrix resin typically is a hardenable or thermoset resin containing one or more uncured thermoset resins or thermoplastic resin. Suitable thermoset resins include, but are not limited to, epoxy resins, oxetanes, imides (such as polyimide or bismaleimide), vinyl ester resins, cyanate ester resins, isocyanate-modified epoxy resins, phenolic resins, furanic resins, benzoxazines, formaldehyde condensate resins (such as with urea, melamine or phenol), polyesters, acrylics, hybrids, blends and combinations thereof. Suitable thermoplastic resins include, but are not limited to polyolefins, fluoropolymers, perfluorosulfonic acids, poly amid-imides, polyamides, polyesters, polyketones, polyphenylene sulfides, polyvinylidene chlorides, sulfone polymers, hybrids, blends and combinations thereof.

Suitable epoxy resins include glycidyl derivatives of aromatic diamine, aromatic mono primary amines, aminophenols, polyhydric phenols, polyhydric alcohols, polycarboxylic acids and non-glycidyl resins produced by peroxidation of olefinic double bonds. Examples of suitable epoxy resins include polyglycidyl ethers of the bisphenols, such as bisphenol A, bisphenol F, bisphenol S, bisphenol K and bisphenol Z; polyglycidyl ethers of cresol and phenol-based novolacs, glycidyl ethers of phenol-aldelyde adducts, glycidyl ethers of aliphatic dials, diglycidyl ether, diethylene glycol diglycidyl ether, aromatic epoxy resins, aliphatic polyglycidylethers, epoxidised olefins, brominated resins, aromatic glycidyl amines, heterocyclic glycidyl imidines and amides, glycidyl ethers, fluorinated epoxy resins, or combinations thereof.

Specific examples are tetraglycidyl derivatives of 4,4'-diaminodiphenylmethane (TGDDM), resorcinol diglycidyl ether, triglycidyl-p-aminophenol, triglycidyl-m-aminophenol, bromobisphenol F diglycidyl ether, tetraglycidyl derivatives of diaminodiphenylmethane, trihydroxyphenyl methane triglycidyl ether, polyglycidylether of phenol-formaldehyde novolac, polyglycidylether of o-cresol novolac or tetraglycidyl ether of tetraphenylethane.

Suitable oxetane compounds, which are compounds that comprise at least one oxetano group per molecule, include compounds such as, for example, 3-ethyl-3[[(3-ethyloxetane-3-yl)methoxy]methyl]oxetane, oxetane-3-methanol, 3,3-bis-(hydroxymethyl) oxetane, 3-butyl-3-methyl oxetane, 3-methyl-3-oxetanemethanol, 3,3-dipropyl oxetane, and 3-ethyl-3-(hydroxymethyl) oxetane.

The curable matrix resin may optionally comprise one or more additives such as curing agents, curing catalysts, co-monomers, rheology control agents, tackifiers, inorganic or organic fillers, thermoplastic and/or elastomeric polymers as toughening agents, stabilizers, inhibitors, pigments, dyes, flame retardants, reactive diluents, UV absorbers and other additives well known to those of ordinary skill in the art for modifying the properties of the matrix resin before and/or after curing.

Examples of suitable curing agents include, but are not limited to, aromatic, aliphatic and alicyclic amines, or guanidine derivatives. Suitable aromatic amines include 4,4'-diaminodiphenyl sulphone (4,4'-DDS), and 3,3'diaminodiphenyl sulphone (3,3'-DDS), 1,3-diaminobenzene, 1,4-diaminobenzene, 4,4'-diammodiphenylmethane, benzenediamine (BDA); Suitable aliphatic amines include ethylenediamine (EDA), 4,4'-methylenebis(2,6-diethylaniline) (M-DEA), m-xylenediamine (mXDA), diethylenetriamine (DETA), triethylenetetramine (TETA), trioxatridecanediamine (TTDA), polyoxypropylene diamine, and further homologues, alicyclic amines such as diaminocyclohexane (DACH), isophoronediamine (IPDA), 4,4' diamino dicyclohexyl methane (PACM), bisaminopropylpiperazine (BAPP), N-aminoethylpiperazine (N-AEP); Other suitable curing agents also include anhydrides, typically polycarboxylic anhydrides, such as nadic anhydride, methylnadic anhydride, phthalic anhydride, tetrahydrophthalic anhydride, hexahydrophthalic anhydride, methyltetrahydrophthalic anhydride, methylhexahydrophthalic anhydride, endomethylene-tetrahydrophtalic anhydride, pyromellitic dianhydride, chloroendic anliydride and trimellitic anhydride.

Still other curing agents are Lewis acid:Lewis base complexes. Suitable Lewis acid:Lewis base complexes include, for example, complexes of: $BCl_3$:amine complexes, $BF_3$:amine complexes, such as $BF_3$:monoethylamine, $BF_3$:propylamine, $BF_3$:isopropyl amine, $BF_3$:benzyl amine, $BF_3$:chlorobenzyl amine, $BF_3$:trimethylamine, $BF_3$:pyridine, $BF_3$:THF, $AlCl_3$:THF, $AlCl_3$:acetonitrile, and $ZnCl_2$:THF.

Additional curing agents are polyamides, polyamines, amidoamines, polyamidoamines, polycycloaliphatic, polyetheramide, imidazoles, dicyandiamide, substituted ureas and urones, hydrazines and silicones.

Urea based curing agents are the range of materials available under the commercial name DYHARD (marketed by Alzchem), and urea derivatives, such as the ones commercially available as UR200, UR300, UR400, UR600 and UR700. Urone accelerators include, for example, 4,4-methylene diphenylene bis(N,N-dimethyl urea) (available from Onmicure as U52 M).

When present, the total amount of curing agent is in the range of 1 wt % to 60 wt % of the resin composition. Typically, the curing agent is present in the range of 15 wt % to 50 wt %, more typically in the range of 20 wt % to 30 wt %.

Suitable toughening agents may include, but are not limited to, homopolymers or copolymers either alone or in combination of polyamides, copolyamides, polyimides, aramids, polyketones, polyetherimides (PEI), polyetherketones (PEK), polyetherketoneketone (PEKK), polyetheretherketones (PEEK), polyethersulfones (PES), polyetherethersulfones (PEES), polyesters, polyurethanes, polysulphones, polysulphides, polyphenylene oxide (PPO) and modified PPO, poly(ethylene oxide) (PEO) and polypropylene oxide, polystyrenes, polybutadienes, polyacrylates, polystyrene, polymethacrylates, polyacrylics, polyphenylsulfone, high performance hydrocarbon polymers, liquid crystal polymers, elastomers, segmented elastomers and core-shell particles.

Toughening particles or agents, when present, may be present in the range 0.1 wt % to 30 wt % of the resin composition. In an embodiment, the toughening particles or agents may be present in the range 10 wt % to 25 wt %. In another embodiment, the toughening particles or agents may be present in the range from 0.1 to 10 wt %. Suitable toughening particles or agents include, for example, Virantage VW10200 FRP, VW10300 FP and VW10700 FRP from Solvay, BASF Ultrason E2020 and Sumikaexcel 5003P from Sumitomo Chemicals.

The toughening particles or agents may be in the form of particles having a diameter larger than 20 microns to prevent them from being incorporated into the fiber layers.

The size of the toughening particles or agents may be selected such that they are not filtered by the fiber reinforcement. Optionally, the composition may also comprise inorganic ceramic particles, microspheres, micro-balloons and clays.

The resin composition may also contain conductive particles such as the ones described in PCT International Publications WO 2013/141916, WO 2015/130368 and WO 2016/048885.

The mold for resin infusion may be a two-component, closed mold or a vacuum bag sealed, single-sided mold. Following infusion of the matrix resin in the mold, the mold is heated to cure the resin.

During heating, the resin reacts with itself to form cross-links in the matrix of the composite material. After an initial period of heating, the resin gels. Upon gelling, the resin no longer flows, but rather behaves as a solid. After gel, the temperature or cure may be ramped up to a final temperature to complete the cure. The final cure temperature depends on the nature and properties of the thermosetting resin chosen. Thus, in a suitable method, the composite material is heated to a first temperature suitable to gel the matrix resin, after which the temperature is ramped up to a second temperature and held for a time at the second temperature to complete the cure.

Thus, a composite article is obtained by curing the composite material described herein.

The apparatuses, systems, methods and processes according to the present disclosure are further illustrated by the following non-limiting examples.

Example 1. Spinning of Polymer Dope

Polymer dope comprising polyacrylonitrile-based polymer was wet-spun into a coagulation bath containing 50/50 DMSO/water using a 50K spinneret secured in 4 different spinneret housings in which the dimensions of the frustoconical cowl, i.e., length of the cowl, diameter of the cowl opening, angle at the top of the cowl, and angle at the bottom of the cowl, were varied. For comparison, the same polymer dope comprising polyacrylonitrile-based polymer was wet-spun into a coagulation bath containing 50/50 DMSO/water using a 50K spinneret in the absence of the spinneret housing. The white fiber tows made with and without the spinneret housing were collected. The dimensions of the inventive spinneret housings are summarized below.

TABLE 1

| Design | Length of cowl* (mm) | Diameter of cowl opening (mm) | Angle at the bottom of the cowl (degrees) | Angle at the top of the cowl (degrees) | Type |
|---|---|---|---|---|---|
| 1 | 30 | 180 | 18.4 | 0 | asymmetric |
| 2 | 30 | 180 | 18.4 | 18.4 | symmetric |
| 3 | 15 | 170 | 33.69 | 0 | asymmetric |
| 4 | 15 | 170 | 33.69 | 33.69 | symmetric |

*measured from spinneret face

The filament diameters and circularity, including the variability in the filament diameters and circularity, of the fiber tows with and without the spinneret housing of design 2 were measured.

Figure 4:
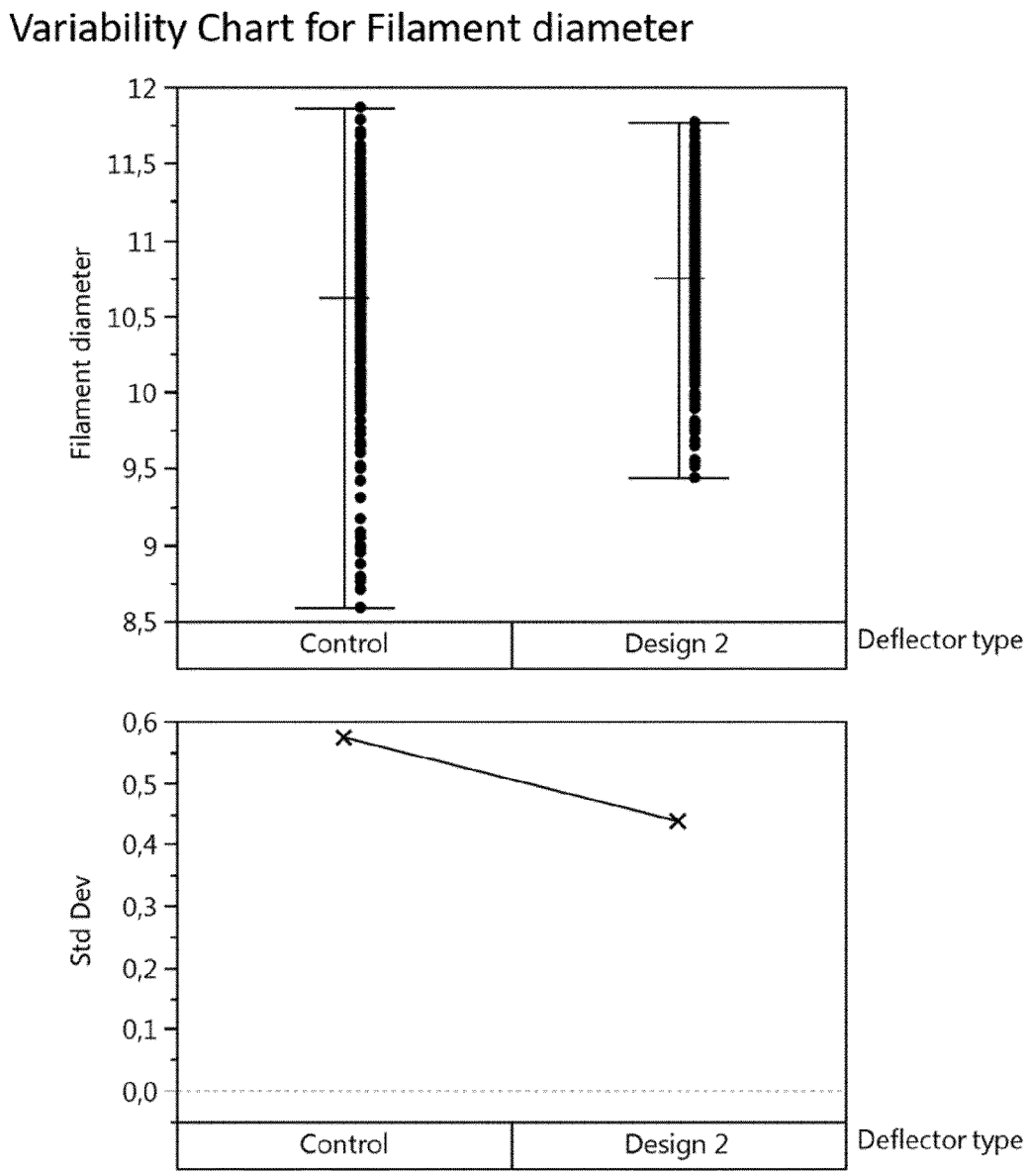
FIG. 4 shows the filament diameters, including standard deviation, determined for white fiber tows made with and without an embodiment of the spinneret housing described herein.

FIG. 4 shows the filament diameters, including standard deviation, determined for white fiber tows made with and without the spinneret housing of design 2. It is apparent that the filament diameters for white fiber tows made with the inventive spinneret housing vary less, i.e., are more uniform, than the filament diameters for white fiber tows made without the inventive spinneret housing.

Figure 5:
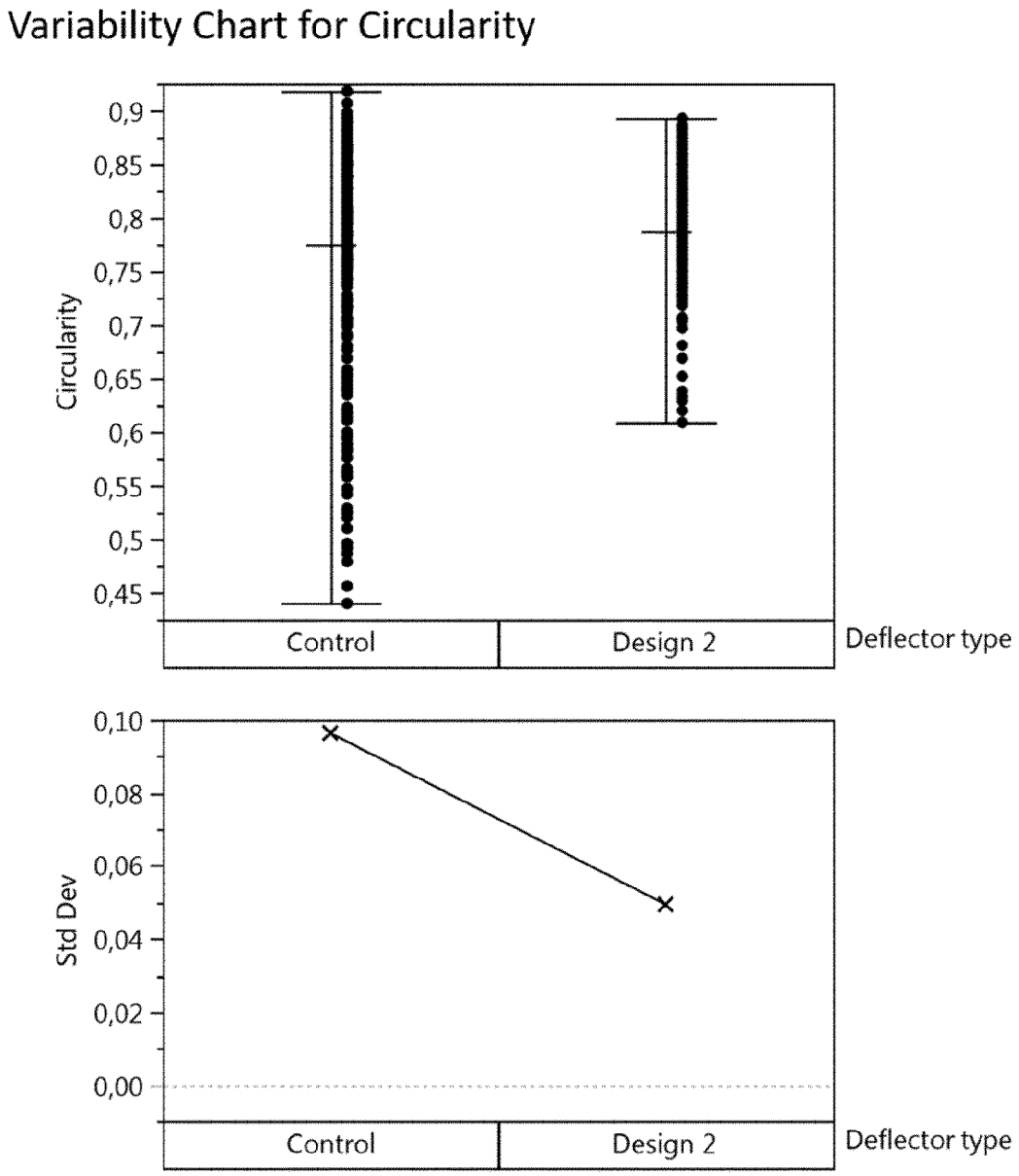
FIG. 5 shows the circularity, including standard deviation, determined for white fiber tows made with and without an embodiment of the spinneret housing described herein.

FIG. 5 shows the circularity determined for white fiber tows made with and without the spinneret housing of design 2. The circularity for white fiber tows made with the inventive with the inventive spinneret housing vary less, i.e., are more uniform, than the circularity for white fiber tows made without the spinneret housing.

What is claimed is:

1. A system for producing polymer fibers, the system comprising:

a) a spinneret housing comprising:

a body with a hollow interior and a back cover, a flanged cylindrical wall extending from the body, wherein the flange is projected radially inward at a distal portion of said cylindrical wall, a cylindrical tube surrounding the entire body and connected to the back cover at one end of the cylindrical tube, wherein said cylindrical tube is coaxial to the flanged cylindrical wall and has a diameter larger than the flanged cylindrical wall, and a cowl extending from the cylindrical tube, wherein the cowl extends past the distal end of the flanged cylindrical wall, b) a polymer dope supply line, c) a spinneret or spinneret assembly positioned inside the hollow interior of the body, and d) a coagulation bath comprising coagulation liquid, wherein the entire body together with the flanged cylindrical wall are in the space defined by the cylindrical tube and the back cover, and wherein the cylindrical tube and the body are configured such that there are one or more openings that allow coagulation liquid to flow through and around the spinneret or spinneret assembly.

2. The system according to claim 1, wherein the spinneret or spinneret assembly is removably supported in the spinneret housing.

3. The system according to claim 1, wherein the polymer dope supply line is connected to an inlet of the spinneret.

4. A process for the production of polymer fibers, the process comprising:

a') providing the system according to claim 1, and b') spinning a polymer dope, which is supplied through the polymer dope supply line to the spinneret or spinneret assembly, into the coagulation bath, wherein the coagulation liquid flows through and around the spinneret or spinneret assembly during spinning.

5. The process according to claim 4, wherein the variability in filament diameter and/or circularity is reduced by 5 to 50% compared to the variability in filament diameter and/or circularity obtained in a process in which the spinneret housing is absent.

6. The system according to claim 1, wherein the spinneret housing is a combination of two or more parts removably secured together.

7. The system according to claim 1, wherein the cowl is a separate structure that is detachable from the cylindrical tube.

8. The system according claim 1, wherein the cowl is cylindrical in shape and has a cylindrical interior with a diameter that is the same as the interior diameter of the cylindrical tube.

9. The system according to claim 1, wherein the cowl has a frustoconical shape.

10. The system according to claim 1, wherein the length of the cowl, measured from the face of the flanged cylindrical wall to the distal opening is 10 to 100 mm.

11. The system according to claim 1, wherein the diameter of the distal opening of the cowl is 100 to 200 mm.

* * * * *